United States Patent [19]

Hall

[11] Patent Number: 4,834,328

[45] Date of Patent: May 30, 1989

[54] SUPPORT FOR EATING UTENSILS

[76] Inventor: Anson L. Hall, 22 Daggett Rd., Attleboro, Mass. 02703

[21] Appl. No.: 143,171

[22] Filed: Jan. 11, 1988

[51] Int. Cl.[4] ..... A47G 21/14

[52] U.S. Cl. ..... 248/37.3; 248/174

[58] Field of Search ..... 248/174, 176, 37.3, 248/37.6; 211/13, 60.1, 70.6, 70.8, 70.1; 206/572, 565; 312/204, 206; 30/296 A, 296 R; D7/74, 73

[56] References Cited

U.S. PATENT DOCUMENTS

| | | | |
|---|---|---|---|
| D. 292,861 | 11/1987 | Dorper | D7/73 |
| 1,647,154 | 11/1927 | Soybel | 248/174 X |
| 1,886,075 | 11/1932 | Zorsch | 211/70.7 |
| 2,299,829 | 10/1942 | Feddersen et al. | 248/174 |
| 2,651,927 | 9/1953 | Mullins | 248/37.3 X |
| 3,239,177 | 3/1966 | Samsing | 248/174 |
| 3,382,986 | 5/1968 | Pfeiffer | 248/174 X |
| 4,234,148 | 11/1980 | Maddestra | 248/174 |
| 4,531,696 | 7/1985 | Bettesworth | D7/74 |

FOREIGN PATENT DOCUMENTS

| | | | |
|---|---|---|---|
| 1025356 | 3/1953 | France | 248/37.3 |
| 243914 | 12/1925 | United Kingdom | 248/37.3 |

*Primary Examiner*—J. Franklin Foss

*Attorney, Agent, or Firm*—Salter & Michaelson

[57] ABSTRACT

A support for eating utensils includes a support frame having front and rear edges which are receivable on a supporting surface, a raised central support portion having one or more transversely spaced apertures in the central support portion which are adapted for receiving and supporting the eating end of a spoon, the blade end of a knife and/or the eating end of a fork in upwardly spaced relation to the supporting surface.

13 Claims, 2 Drawing Sheets

SUPPORT FOR EATING UTENSILS

BACKGROUND AND SUMMARY OF THE INVENTION

The instant invention relates to eating utensils and more particularly to a disposable support for supporting a set of eating utensils on a table top, counter top or the like.

It has been found that eating utensils can frequently become contaminated with bacteria and/or other foreign substances when they are placed on the surfaces of counter tops, table tops or the like prior to and/or between periods of use. Nevertheless, heretofore it has been common practice to place eating utensils directly on counter tops, table tops or the like in many restaurants, such as sandwich shops and fast-food restaurants. In this connection, food is often served in paper or synthetic wrappings without plates in restaurants of this type, and hence there is often no convenient place for utensils to be rested both prior to and between periods of use other than directly on table tops or counter tops. As a result, there is a significant need for an effective disposable device for supporting eating utensils on table tops and/or counter tops, both prior to and between periods of use.

Devices representing the closest prior art of the subject invention of which the applicant is aware are disclosed in the U.S. Pats. Nos. to DODGE, 227,224; MOORE, 799,612; FRESH, 1,264,914; PICKERING, 2,354,968; LUNDE, 2,567,817; GRAY, 2,615,318; MULLING, 2,651,927; LEE, 2,789,349; and BROWN, Des. 196,133. However, these references fail to disclose an effective disposable support for supporting a set of eating utensils in the manner of the device of the subject invention, and hence they are believed to be of only general interest.

The instant invention provides an effective support for eating utensils comprising an elongated support frame made from a substantially rigid sheet material, the support frame including spaced, substantially parallel, transversely extending front and rear edges, and an elongated transversely extending raised central support portion which extends between the front and rear edges. The central support portion is formed with first, second and third transversely spaced apertures therein which are adapted for receiving and supporting a spoon, a knife, and a fork, respectively. Specifically, the first aperture is preferably formed so that it includes arcuate front and rear edges, and it is adapted for supporting the eating end of a spoon on the front and rear edges thereof; and the second aperture is preferably formed in the configuration of an elongated V-shaped slot which extends in substantially perpendicular relation to the front and rear edges of the support frame so that it is adapted for receiving and supporting the blade end of a knife in a substantially vertical on-edge disposition therein. The third aperture is preferably formed so that it includes spaced, substantially parallel, transversely extending front and rear edges, and it is adapted for supporting the eating end of a table fork on the front and rear edges thereof.

In a first embodiment of the support of the instant invention, the upper support portion is defined by substantially flat front and rear wall portions which extend upwardly from the front and rear edges, respectively; and are integrally hingeably joined at an apex. In this embodiment, the support further comprises a bottom wall including a first bottom wall portion which is integrally hingeably connected to the front wall portion along the front edge, and a second bottom wall portion which is integrally hingeably connected to the rear wall portion along the rear edge. Further, one of the bottom wall portions has an elongated slot formed therein, and the other bottom wall portion further comprises a peripheral tab thereon which is receivable in the slot for detachably connecting the first and second bottom wall portions in an assembled position wherein they cooperate to define the bottom wall. This embodiment of the support preferably further comprises salt and pepper packets which are releasably secured to the bottom wall adjacent opposite ends thereof, and the first and second bottom wall portions, the front wall portion and the rear wall portion are preferably all integrally formed from a sheet of cardboard material so that the support can be effectively stored in a substantially flat sheet-like disposition and then quickly assembled prior to use.

A second embodiment of the support of the instant invention includes a raised central support portion having front and rear edges and including substantially flat front and rear wall portions which extend upwardly and together from the front and rear edges, respectively, to an apex. In this embodiment, the support further comprises a bottom wall portion which is hingeably joined to the front and rear edges of the support frame so that it extends therebetween, and the bottom wall has opposite first and second ends which are disposed at transversely opposite ends of the support. This embodiment of the support further comprises first and second drip tabs which are hingeably joined to the first and second ends of the bottom wall, respectively, and are normally positioned so that they extend upwardly between the front and rear wall portions. Further, the bottom wall preferably has an elongated score line formed therein which divides the bottom wall into front and rear sections, respectively, and the first and second drip tabs preferably also have score lines formed therein which are aligned with the score line in the bottom wall. Accordingly, by hinging the drip tabs outwardly, the front and rear bottom wall sections can be hinged outwardly along the score line in the bottom wall to move the support to a substantially flat, collapsed disposition wherein the front and rear bottom wall sections are overlaid on one another and the front and rear walls are also overlaid on one another. Accordingly, the second embodiment of the support of the instant invention is also adapted to be effectively transported and stored in a substantially flat collapsed disposition, but it can nevertheless be readily assembled by hingeably moving the front and rear wall portions outwardly until the front and rear bottom wall sections are in substantially coplanar relation, and then folding the drip tabs upwardly.

In a third embodiment of the support of the instant invention, the support frame is formed in a substantially rigid, arcuate configuration so that it extends arcuately upward and rearwardly from the front edge to the uppermost portion of the support frame and then arcuately rearwardly and downwardly to the rear edge of the support frame. This embodiment of the support preferably does not include a bottom wall, and hence it is effectively adapted to be assembled in nested relation with other utensil supports of similar configuration.

Accordingly, it is a primary object of the instant invention to provide an effective disposable support for eating utensils.

Another object of the instant invention is to provide an effective disposable support for eating utensils which can be stored in a collapsed disposition.

An even still further object of the instant invention is to provide an effective support for eating utensils which can be made in a relatively inexpensive cardboard or plastic construction.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
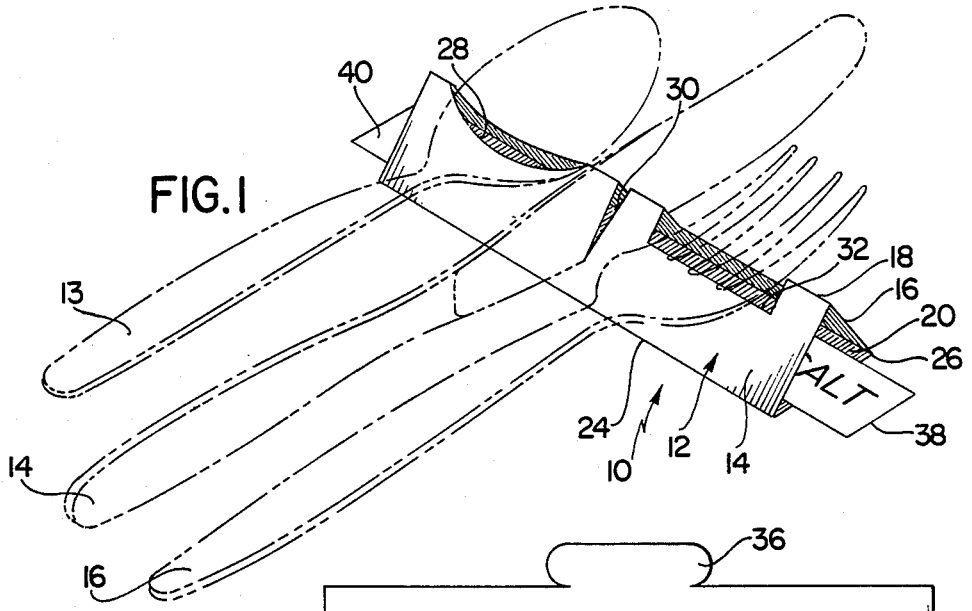
FIG. 1 is a perspective view of a first embodiment of the disposable support of the instant invention.
Figure 2:
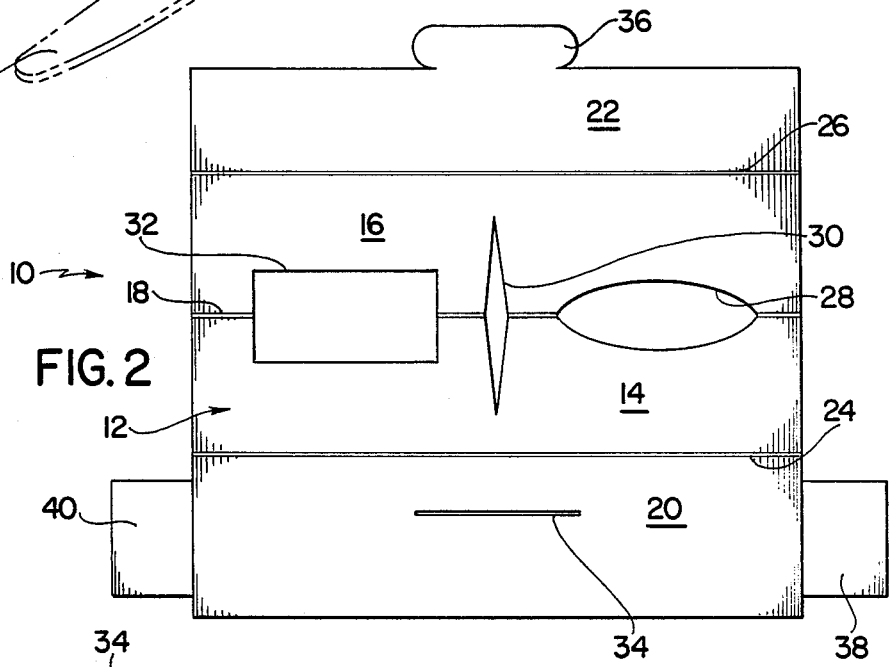
FIG. 2 is a bottom plan view thereof in a collpased disposition prior to assembly.
Figure 3:
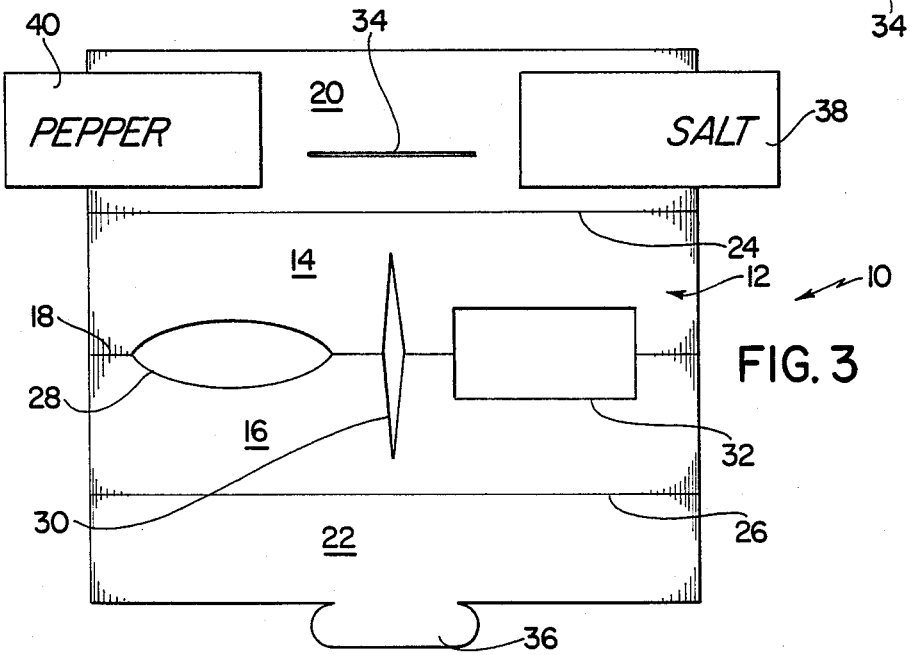
FIG. 3 is a top plan view thereof in a collapsed disposition prior to assembly.

Referring now to the drawings, a first embodiment of the support for eating utensils of the instant invention is illustrated in FIGS. 1—3 and generally indicated at 10. The support 10 is preferably made from a suitable disposable, substantially rigid sheet material, such as cardboard, and it is operative for supporting the eating end of a spoon 13, the blade end of a knife 14, and the eating end of a fork 16 in upwardly spaced relation to a supporting surface, such as a counter top or a table top.

As illustrated in FIGS. 2 and 3, the suppoort 10 is preferably integrally formed from a substantially rigid sheet material, and it can be effectively stored in a flattened or collapsed disposition and quickly assembled prior to use. The support 10 comprises a support frame generally indicated at 12 including elongated, substantially flat front and rear wall portions 14 and 16, respectively, which are hingeably connected along a fold or score line 18, and front and rear bottom wall sections 20 and 22, respectively. The front bottom wall section 20 is hingeably connected to the front wall portion 14 along a fold or score line 24, and the rear bottom wall section 22 is hingeably connected to the rear wall portion 16 along a fold or score line 26. First, second and third apertures 28, 30 and 32, respectively, are formed in the support frame 12 so that they intersect the score line 18, and an elongated slot 34 is formed in the front bottom wall section 20. In this connection, it should be pointed out that although the support 10 as herein embodied includes the three apertures 28, 30 and 32, it will be understood that other embodiments which only include fewer than three apertures, as well as other embodiments which inlcude more than three apertures, are contemplated. A tab 36 is formed on the peripheral edge of the rear bottom wall section 22, the tab 36 being adapted and dimensioned to be received in interlocking engagement in the slot 20 in order to retain the support 10 in the assembled position illustrated in FIG. 1. Accordingly, when the support 10 is in the assembled position, the score line 26 defines the front edge of the support frame 12 and the score line 24 defines the rear edge of the support frame 12, whereas the score line 18 defines an apex of the support frame 12. The first aperture 28 is formed with substantially arcuate front and rear edges so that it is adapted for receiving and supporting the eating end of the spoon 13 in the manner illustrated in FIG. 1, and the third aperture 32 is formed with substantially straight, parallel front and rear edges so that it is adapted for receiving and supporting the eating end of the fork 16. The second aperture 30 is formed in the configuration of an elongated, narrow slot which extends in substantially perpendicular relation to the front and rear edges of the support frame 12 and which is adapted for receiving and supporting the blade end of a knife in a substantially vertical on-edge disposition in the manner illustrated in FIG. 1. The support 10 preferably further comprises packets 38 and 40, respectively, which preferably contain granular substances, such as salt and pepper, respectively and are preferably of disposable paper construction and detachably secured to the front bottom wall section 20 adjacent opposite ends thereof with a suitable releasable adhesive. Further, it will be understood that other embodiments which include packets containing other substances, such as sugar, are also contemplated.

Accordingly, the support 10 is adapted to be stored in the substantially flat collapsed disposition illustrated in FIGS. 2 and 3, but it can be quickly and readily assembled to the erected position illustrated in FIG. 1, and it can be retained in the erected position by assembling the tab 36 in the slot 34. Thereafter, the support 10 can be effectively utilized for supporting the spoon 13, the knife 14, and the fork 16, in the manner illustrated in FIG. 1, and the packets 38 and 40, respectively, are readily accessible and removable from the front bottom wall section 20 as needed.

Figure 4:
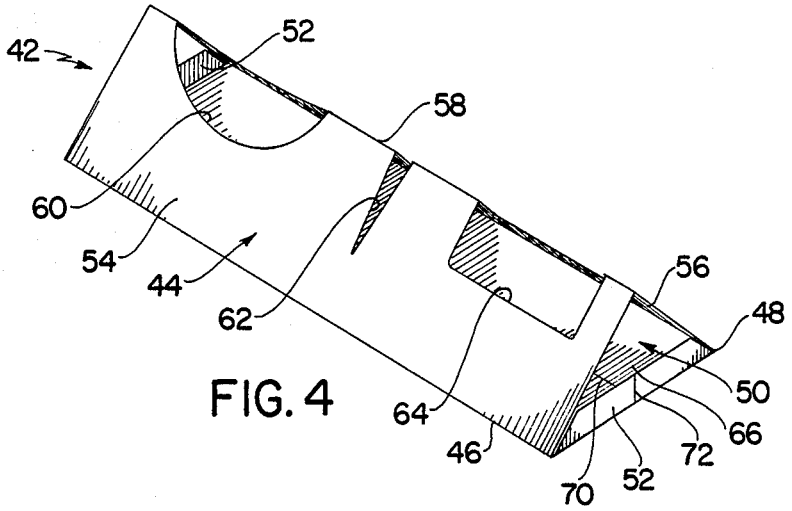
FIG. 4 is a perspective view of a second embodiment of the disposable support of the instant invention in a fully assembled position.
Figure 5:
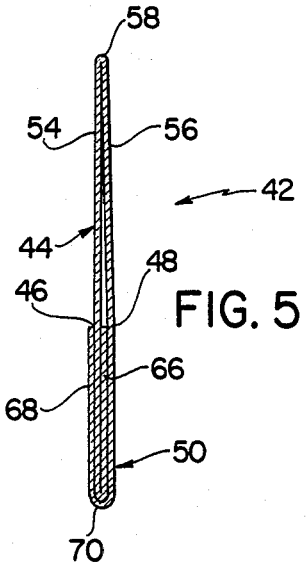
FIG. 5 is an end view thereof in a collapsed disposition.

A second embodiment of the support of the instant invention is illustrated in FIGS. 4 and 5 and generally indicated at 42. The support 42 comprises a support frame generally indicated at 44 having front and rear edges 46 and 48, respectively, and a bottom wall generally indicated at 50 which is hingeably attached to the support frame 44 along fold lines 46 and 48 which define the front and rear edges of the support frame 44, respectively. The support 42 further comprises a pair of drip tabs 52 which are hingeably connected to the bottom wall 50 along fold lines at opposite ends of the bottom wall 50, the drip tabs 52 normally being disposed in upwardly extending positions and being operative for preventing fluids which have spilled from the spoon 13, the knife 14 and/or the fork 16 from spilling ouwardly onto a table top. The support frame 44 includes front and rear wall portions 54 and 56 which extend upwardly and together from the front and rear edges 46 and 48, respectively, and are hingeably joined along a fold line 58 which defines an apex of the support frame 44 when the support 42 is in the erected position illustrated in FIG. 4. First, second and third transversely spaced apertures 60, 62 and 64, respectively, are formed in the support frame 44 so that they intersect the fold line 58. In this regard, the first aperture 60 is perferably formed with substantially arcuate front and rear edges so that it is adapted for receiving and supporting the eating end of a spoon, and the second aperture 62 is formed in the configuration of an elongated narrow rearwardly extending slot so that it is adapted for receiving and supporting the blade end of a table knife in a substantially vertical on-edge disposition. The third aperture 64 is preferably formed so that it includes substantially straight, substantially parallel front and rear edges which are adapted for effectively supporting the eating end of a table fork. Again, however, other embodiments of the support 42 which include fewer or more than three apetures are contemplated. The bottom wall 50 comprises upper and lower bottom wall flaps 66 and 68, respectively, which are integrally attached to the front and rear wall portions 54 and 56, respectively, along the front and rear edges 46 and 48, respectively. The upper bottom wall flap 66 is preferably permanently secured in overlying relation on the bottom wall flap 68 with a suitable adhesive, and a fold line 70 is formed in the bottom wall 50 so that it extends between the opposite ends thereof in substantially equally spaced relation from the front and rear edges 46 and 48. The drip tabs 52 are preferably integrally formed with the bottom wall flaps 66 and 68, and hence they preferably also have two-layered constructions. The side edges of the drip tabs 52 are preferably formed in angular configurations to enable the drip tabs 52 to be effectively received in the ends of the support frame 44 in the manner illustrated in FIG. 4. The drip tabs 52 are preferably also formed with fold lines 72 are which substantially aligned with the fold line 70.

Accordingly, the support 42 can also be effectively stored in a flattened, collapsed disposition, and then quickly and easily moved to an erected disposition prior to use. More specifically, the support 42 can be positioned in the collapsed disposition illustrated in FIG. 5 by folding the drop tabs 52 outwardly so that they are substantially parallel with the bottom wall 50 and then folding the bottom wall 50 and the drip tabs 52 outwardly along the fold lines 70 and 72, respectively, until the front wall portion 54 is overlaid on the rear wall portion 56. When the support 42 is in this position, it can be effectively stored in a minimum of space, and it can be readily and easily assembled to the erected position thereof by performing a reverse series of operations.

Figure 6:
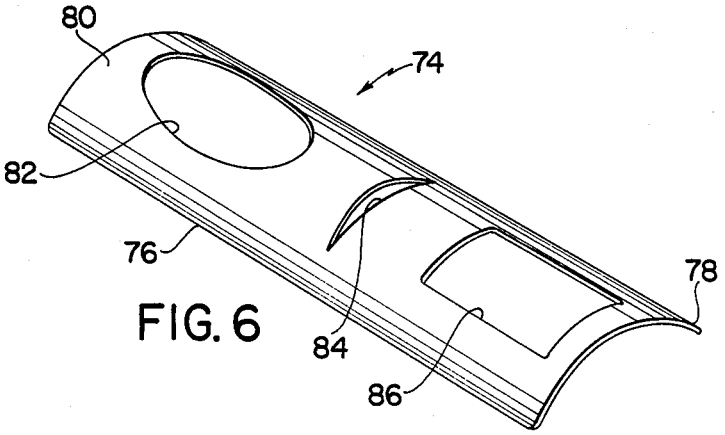
FIG. 6 is a perspective view of a third embodiment of the disposable support.

A third embodiment of the support of the instant invention is illustrated in FIG. 6 and generally indicated at 74. The support 74 is preferably also made from a suitable rigid sheet material, such as a suitable cardboard; although it can also be integrally molded from a suitable plastic material. The support 74 comprises a support frame having front and rear edges 76 and 78, respectively, and a raised central support portion 80. The raised central support portion 80 is formed in a rounded configuration so that it extends arcuately upwardly and rearwardly from the front edge 76 and then arcuately downwardly and rearwardly to the rear edge 78. Formed in the raised central support portion 80 are first, second and third apertures 82, 84 and 86, respectively, which are adpated for receiving and supporting the eating end of a spoon, the blade end of a knife, and the eating end of a fork, respectively. In this regard, the first aperture 82 is preferably formed in a substantially oval configuration so that it has rounded front and rear edges which are adapted for receiving and supporting the eating end of a spoon. The second aperture 84 is formed in the configuration of a narrow, rearwardly extending slot so that it is adapted for receiving and supporting the blade end of a knife in a substantially vertical on-edge disposition. The third aperture 86 is preferably formed so that it includes substantially straight and parallel front and rear edge which are also substantially parallel to the front and rear edges 76 and 78, and accordingly, the third aperture 86 can be effectively utilized for receiving and supporting the eating end of a fork. Other embodiments of the support 74 which include fewer or more than three apertures are also contemplated.

The support 74 is also adpated to be effectively stored in a minimal amount of sapce, and it can be utilized when needed without requiring assembly. Specifically, the support 74 can be effectively stored in nested relation with a plurality of supports of similar configuration, and it can be placed on a supporting surface such as a counter top or a table top for supporting a set of table utensils in upwardly spaced relation.

It is seen therefore that the instant invention provides an effective support which can be utilized for supporting a set of eating utensils on a counter top or a table top. The supports 10, 42 and 74 are adapted for relatively inexpensive constructions, and they are also adapted to be stored in minimal amounts of space. However, the supports 10, 42 and 74 can nevertheless be easily and readily utilized when needed. Accordingly, it is seen that the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A support for utensils and the like comprising an elongated support frame including substantially flat front and rear wall portions made from a substantially rigid material, said front and rear wall portions having spaced, substantially parallel, transversely extending front and rear edges, respectively, said front and rear wall portions extending upwardly and together from said front and rear edges, respectively, to an apex and being joined at said apex, said support frame having an aperture therein which intersects said apex and is adapted for receiving and supporting an eating utensil, said support further comprising a substantially flat bottom wall extending between said front and rear edges, said bottom wall extending along substantially the entire extents of said front and rear edges and terminating in first and second ends, and first and second drip tabs joined to said bottom wall along fold lines which extend along said first and second ends, said drip tabs extending upwardly from said first and second ends, respectively, and substantially between said front and rear edges.

2. The support of claim 1 further characterized as made of a sheet material, said front and rear wall portions being hingeably connected to said bottom wall along said front and rear edges, respectively, and being hingeably connected to each other along said apex, said bottom wall having an elongated fold line therein which is substantially parallel to said front and rear edges and divides said bottom wall into front and rear bottom wall sections, respectively, said support being positionable in a substantially flat, collapsed disposition wherein said front wall portion is substantially coplanar with said rear wall portion, and said bottom wall front section is overlaid on said bottom wall rear section.

3. In the support of claim 2, said front wall portion being overlaid on said rear wall portion when said support is in said collapsed disposition.

4. In the support of claim 1, said bottom wall having opposite first and second ends which extend between said front and rear edges, said support further comprising a packet containing a granular substance and releasably secured to said bottom wall adjacent an end thereof.

5. The support of claim 1 further characterized as being made of a sheet material, said bottom wall comprising first and second bottom wall portions, said first bottom wall portion being hingeably connected to said front wall portion, said section bottom wall portion being hingeably connected to said rear wall portion, said first and second bottom wall portions being secured together in a position wherein they cooperate to define said bottom wall, said front wall portion and said rear wall portion being hingeably connected along said apex.

6. In the support of claim 5, said first and second bottom wall portions being releasably connected in said position wherein they cooperate to define said bottom wall.

7. In the support of claim 6, one of said bottom wall portions having a slot formed therein, the other of said bottom wall portions having a peripheral tab formed thereon, said tab being receiving in said slot for releasably connecting said first and second bottom wall portions.

8. The support of claim 6, further characterized as being made of cardboard.

9. The support of claim 6, further characterized as being made of plastic.

10. A support for eating utensils comprising an elongated support frame made from a substantially rigid sheet material and including elongated, spaced substantially parallel, transversely extending front and rear edges, and a transversely elongated central support portion extending upwardly and rearwardly from said front edge and then downwardly and rearwardly to said rear edge, said support frame being adapted to be received on a supporting surface with said front and rear edges positioned adjacent said supporting surface and with at least a portion of said central support portion in upwardly spaced relation to said supporting surface, said central support portions having an aperture therein which is adapted for receiving and supporting an eating utensil, said support further comprising a substantially flat bottom wall extending between said front and rear edges, said bottom wall extending along substantially the entire extents of said front and rear edges and terminating in first and second ends, and first and second drip tabs joined to said bottom wall along fold lines which extend along said first and second ends, said drip tabs extending upwardly from said first and second ends, respectively, and substantially between said front and rear edges.

11. In the support of claim 10, said central support portion having first, second and third transversely spaced apertures therein which are adapted for receiving and supporting the eating end of a spoon, the blade end of a table knife, and the eating end of a fork, respectively.

12. In the support of claim 11, said first aperture having arcuate front and rear edges and being adpated for supporting the eating end of a spoon on the front and rear edges thereof, said second aperture being formed in the configuration of an elongated V-shaped slot which extends in a direction substantially perpendicular to said support frame front and rear edges and being adapted for receiving and supporting the blade end of a table knife therein in a substantially vertical, on-edge disposition, said third aperture having spaced, substantially parallel, transversely extending front and rear edges and being adapted for supporting the eating end of a table fork on the front and rear edges thereof.

13. In the support of claim 11, said central support portion extending arcuately upwardly from said front edge and then arcuately rearwardly and downwardly to said rear edge.

* * * * *